United States Patent [19]

Sutcliffe

[11] 4,010,781

[45] Mar. 8, 1977

[54] GASOLINE DISPENSING NOZZLE GUARD WITH SPOUT ENCLOSURE AND VAPOR RETURN LINE

[75] Inventor: Grenville G. Sutcliffe, Villa Ridge, Mo.

[73] Assignee: Husky Corporation, Pacific, Mo.

[22] Filed: Mar. 31, 1975

[21] Appl. No.: 563,808

[52] U.S. Cl. ..... 141/392; 141/217; 141/310; 141/390

[51] Int. Cl.[2] ..... B65B 3/04

[58] Field of Search ..... 141/45, 59, 97, 217, 141/310, 390, 392

[56] References Cited

UNITED STATES PATENTS

| | | | |
|---|---|---|---|
| 2,850,049 | 9/1958 | Lomax | 141/310 |
| 3,581,782 | 6/1971 | Onufer | 141/59 |
| 3,710,830 | 1/1973 | Gilson | 141/392 |
| 3,823,752 | 7/1974 | Lasater et al. | 141/217 |
| 3,840,055 | 10/1974 | Wastl et al. | 141/392 |
| 3,899,009 | 8/1975 | Taylor | 141/97 |
| 3,907,010 | 9/1975 | Burtis et al. | 141/45 |

*Primary Examiner*—Steven L. Stephan
*Attorney, Agent, or Firm*—F. Travers Burgess

[57] ABSTRACT

A guard for fuel dispensing nozzles is formed with a hollow projection surrounding and radially spaced from the nozzle spout for sealing engagement with structure surrounding the filler opening of a gasoline tank to provide for vapor recovery and is formed with a receptacle for a vapor return line communicating with the interior of the hollow projection.

8 Claims, 6 Drawing Figures

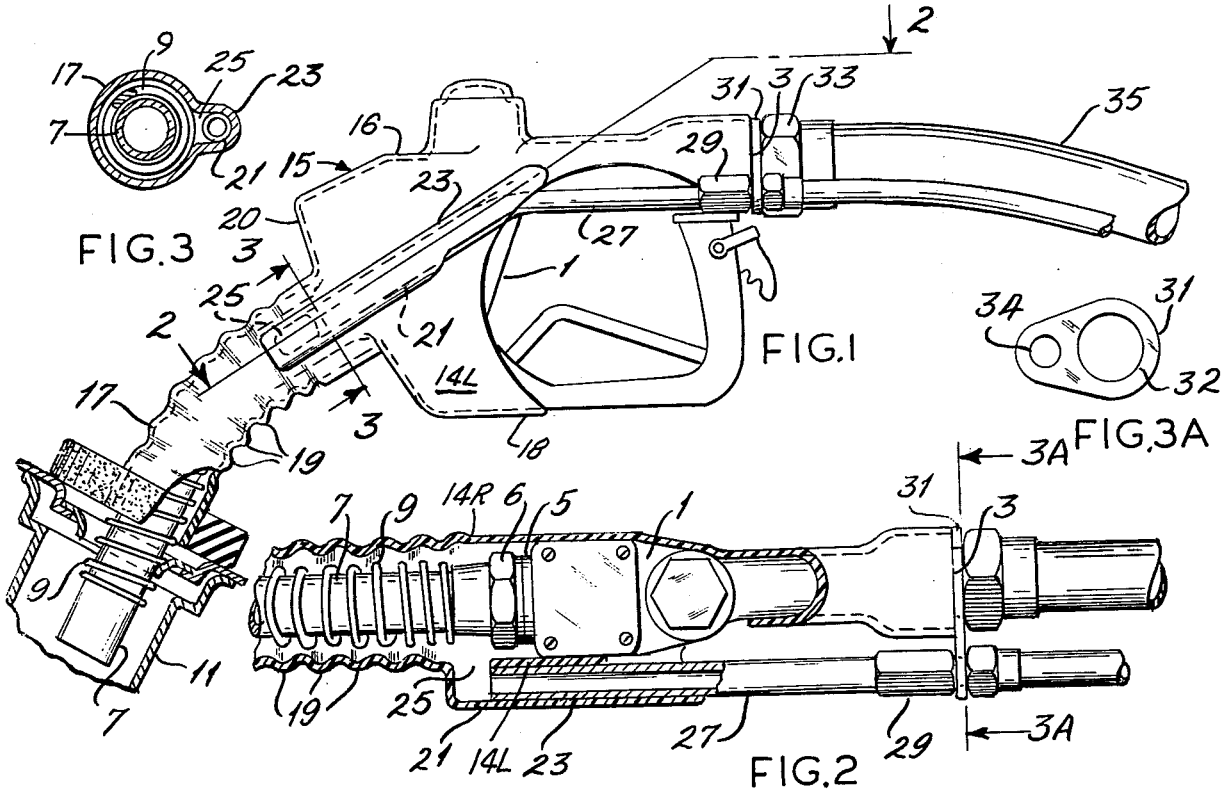
FIG.3
FIG.1
FIG.3A
FIG.2
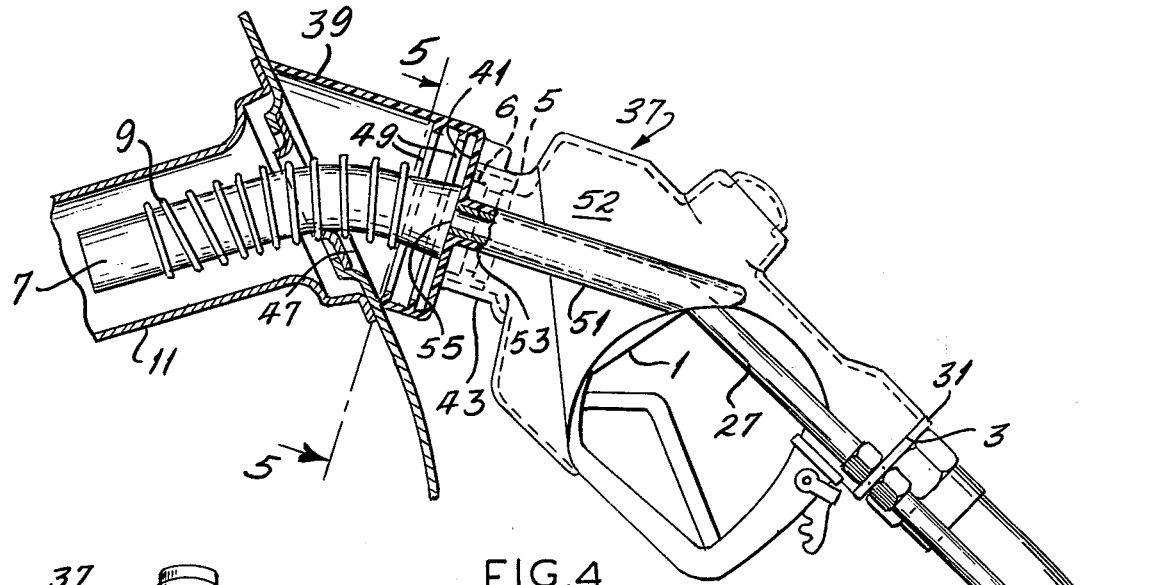
FIG.4
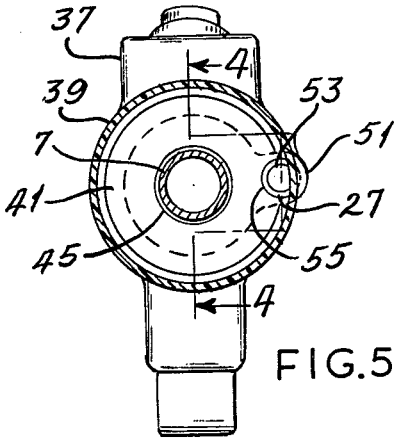
FIG.5

GASOLINE DISPENSING NOZZLE GUARD WITH SPOUT ENCLOSURE AND VAPOR RETURN LINE

BACKGROUND OF THE INVENTION

1. Field of the Invention

The invention relates to fuel dispensing nozzle guards and consists particularly in a nozzle guard formed with vapor collection and return means.

2. The Prior Art

The application to fuel dispensing nozzles of separate flexible tubular members surrounding the spout and adapted for sealing engagement around the filler opening of a fuel tank, in combination with a tube for returning vapors collected in the tubular member to the storage tank have been disclosed in U.S. Pat. Nos. 3,566,928 (U.S. Pat. No. Re. 28,294) and 3,823,752. None of the prior art discloses constructions in which a vapor collecting shroud or hood surrounding the spout is an integral part of the nonmetallic guard enclosing the body of a fuel dispensing nozzle.

SUMMARY OF THE INVENTION

The invention provides means integral with gasoline dispensing nozzle guards for returning vapors emitted from fuel tanks of automobiles and the like during filling to the gasoline pump and storage tank.

The integral vapor return means comprises a hollow projection extending from the nozzle body portion of the guard and surrounding the nozzle spout and adapted for sealing engagement by its outer end with the periphery of the fuel tank inlet, and a passageway integral with the body portion of the nozzle guard, communicating with the hollow projection and adapted to receive a separate vapor return tube leading to the gasoline pump or fuel storage tank.

BRIEF DESCRIPTION OF THE DRAWINGS:

FIG. 1 is a side elevational view, partially sectionalized, showing a dispensing nozzle with guard embodying the invention.

FIG. 2 is a fragmentary top view of the nozzle and guard illustrated in FIG. 1, with the guard partially sectionalized along line 2—2 of FIG. 1.

FIG. 3 is a transverse sectional view along line 3—3 of FIG. 1.

FIG. 3A is a transverse sectional view along line 3A—3A of FIG. 2.

FIG. 4 is a side elevational view of a modified form of the invention.

FIG. 5 is a transverse sectional view along line 5—5 of FIG. 4.

DETAILED DESCRIPTION OF THE INVENTION:

A gasoline dispensing nozzle of a widely used type has a rigid body 1 having an inlet 3, an outlet 5, and a curved discharge spout 7 surrounded by the usual coiled anchor wire 9 for anchoring the spout in the inlet of automobile fuel tank filler neck 11 during filling.

A sheath-like guard of soft impact-absorbing plastic material has a body portion 15 substantially enclosing and thereby protecting nozzle body 1. The guard body portion has spaced side walls 14L and 14R, top wall 16, bottom wall 18 and front wall 20. The rear is open as defined by arcuate edge 22.

For providing a vapor-tight seal between the nozzle and the filler neck inlet, the guard 15 is formed with a hollow hose-like projection 17 from front wall 20 surrounding spout 7 of sufficiently greater diameter than spout 7 to accommodate anchor wire 9, but of somewhat less length than the spout and anchor wire so as to permit the latter to project from the open outer end of projection 17. Projection 17 is peferably transversely corrugated as at 19 to facilitate its accommodation to the curvature of spout 7, and at its outer end is surrounded by an annular seal 20 of yieldable resilient material adapted for sealing engagement with the periphery of the filler neck inlet whereby to prevent the escape at this location of vapors emitted from the filler neck.

For passing the collected vapors from the interior of projection 17 to the gasoline pump housing and thence to the storage tank, guard 15 has an integral passageway 21 formed in an elongated boss 23 on side wall 14L, with its forward end communicating at 25 with the interior of projection 17 adjacent the connection of spout 7 to nozzle outlet 5. Passageway 21 slopes rearwardly and upwardly therefrom to approximately the level of nozzle inlet 3 and its rear end is open. A length of metal tubing 27 extends through passageway 21 from rearwardly of aperture 25, being bent intermediate its ends to extend parallel to the rear portion of the body and end in a fitting 29 abreast of nozzle inlet 3.

For supporting tube 27 from the nozzle body, a plate 31 (FIG. 3A) has a large aperture 32 thrugh which the threaded end of fuel hose fitting 33 passes when threadably secured in the threaded nozzle inlet opening 3 to secure fuel hose 35 to the nozzle body and at the same time secure plate 31 against the inlet end of the nozzle body. Plate 31 is formed with a second radially offset smaller aperture 34 to which vapor tube fitting 29 and vapor return hose fitting 37 are secured.

In operation, the nozzle is positioned with spout 7 inserted into the automobile fuel tank filler neck and annular seal 20 pressed into sealing engagement with the periphery of the filler neck. As fuel passes through spout 7 into the filler neck vapors rising from the filler neck enter projection 17 and pass from it through aperture 25 into tube 27 and thence into the vapor return hose.

The second embodiment of the invention is illustrated in FIGS. 4 and 5 as applied to the same type of nozzle as that of FIGS. 1 and 2, and the nozzle body portion 37 of the guard or sheath is the same shape as that of guard 15 of the first embodiment.

Instead of the corrugated hose-like projection 17 of the first embodiment, the guard of FIGS. 4 and 5 is formed with a spout-surrounding projection in the form of a cylindrical hood 39 of sufficient diameter to completely surround the fuel tank filler neck opening and sealingly engage its periphery. Hood-like projection 39 is formed with an inner transverse end wall 41 connected to the body portion 37 of the guard by a reduced diameter connecting portion surrounding the nozzle outlet 5 and spout locknut 6 and centrally circularly apertured at 45 to permit the passage therethrough of spout 7 and sealingly surround it. Preferably the outer peripheral edge 47 of hood 39 is defined by a plane inclined with respect to the axis of hood 39 with the lower portion of the hood shorter than its upper portion to facilitate inserting the spout into the tank filler neck at a suitable angle. For maintaining the generally cylindrical shape of hood 39, adjacent its inner end it is formed with a pair of axially spaced annular inner ribs 49.

For passing vapors from the interior of hood 39 to the gasoline pump housing and thence to the gasoline storage tank, the guard has an elongated hollow boss 51 along body portion side wall 52 forming a cylindrical passageway 53 which intersects and passes through hood transverse wall 41 at 55 and extends rearwardly and upwardly therefrom. A vapor return tube 27 extends through passageway 53 and rearwardly therefrom as in the first embodiment.

Operation of the device is similar to that of the first embodiment.

The details of the guards may be varied substantially without departing from the spirit of the invention and the exclusive use of such modifications as come within the scope of the appended claims is contemplated.

We claim:

1. The combination of a fuel dispensing nozzle having a body with an elongated inlet passage and an outlet mounting an elongated spout insertible into the filler opening of a fuel tank for discharging fuel thereinto, with a guard comprising a body portion having a front wall, spaced side walls, a top wall and a bottom wall and open at its rear, adapted to fit tightly over and substantialy enclose the nozzle body, a hollow projection extending forwardly from said front wall and adapted to surround the elongated nozzle spout in spaced relation with the exterior thereof and open at its forward end to engage structure surrounding the fuel tank filler opening, an elongated boss on one side wall extending from the rear portion of said hollow projection to the rear edge of said body portion, said boss being hollow and forming a passageway communicating at its forward end directly with the interior of said hollow projection and open at its rear end, and a vapor return tube alongside the nozzle inlet passage with its forward end telescopingly received in said passageway, said nozzle inlet passage having an opening at its rear end adapted to receive a fuel hose fitting, and a plate transverse of said inlet passage apertured to permit the passage therethrough of said hose fitting and adapted to be gripped between said hose fitting and the abutting rear end of said nozzle body, said plate being formed with a second aperture radially spaced from said first aperture to receive and position said vapor return tube.

2. The combination according to claim 1 wherein said hollow projection is an elongated tube of greater diameter than the nozzle spout.

3. The combination according to claim 2 wherein said tube is corrugated transversely of its length to facilitate its compression and bending in comformity with the shape of the spout.

4. The combination according to claim 3 wherein said tube is formed at its end with an annular flange-like portion having a resiliently deformable end surface.

5. The combination according to claim 1 wherein said passageway intersects the side of said projection.

6. The combination according to claim 1 wherein said projection comprises a hood having a generally circular wall coaxial with the body end of said spout and a transverse wall defining the body end of said projection and centrally apertured to accommodate the passage therethrough of said spout.

7. The combination according to claim 6 wherein said body portion includes a passageway intersecting said transverse wall and extending rearwardly therefrom and adapted to receive the end portion of a vapor return tube.

8. The combination according to claim 7 wherein the outer peripheral edge of said hood is oblique to the axis of said hood.

* * * * *